US009308671B2

(12) United States Patent
Baro Cabrero et al.

(10) Patent No.: US 9,308,671 B2
(45) Date of Patent: Apr. 12, 2016

(54) MODULAR MACHINE FOR CUTTING CERAMIC PIECES

(71) Applicant: BELLOTA HERRAMIENTAS, S.A., Legazpia (ES)

(72) Inventors: Josep Baro Cabrero, Legazpia (ES); Josep Torrents Comas, Legazpia (ES)

(73) Assignee: BELLOTA HERRAMIENTAS, S.A., Legazpia (Guipuzcoa) (ES)

( * ) Notice: Subject to any disclaimer, the term of this patent is extended or adjusted under 35 U.S.C. 154(b) by 0 days.

(21) Appl. No.: 14/607,096

(22) Filed: Jan. 28, 2015

(65) Prior Publication Data

US 2015/0224672 A1 Aug. 13, 2015

(30) Foreign Application Priority Data

Feb. 7, 2014 (ES) ..... 201430153

(51) Int. Cl.
*B28D 1/22* (2006.01)

(52) U.S. Cl.
CPC ..... *B28D 1/225* (2013.01)

(58) Field of Classification Search
CPC ..... B28D 1/225; B28D 1/22; B28D 1/24; B28D 1/32; B26D 3/08
USPC ..... 125/23.01, 23.02, 35; 225/96.5, 96; 83/886
See application file for complete search history.

(56) References Cited

U.S. PATENT DOCUMENTS 5,483,749 A 1/1996 Hepworth
5,505,359 A * 4/1996 Joecker, Jr. ..... B28D 1/225 225/96
5,560,274 A * 10/1996 Turner ..... B28D 1/225 125/23.02
6,148,810 A * 11/2000 Hepworth ..... B28D 1/225 125/23.01
6,164,272 A * 12/2000 Fouy ..... B28D 1/225 125/12
6,240,914 B1 6/2001 Yasuga
6,953,036 B2 * 10/2005 Ishii ..... B28D 1/225 125/23.01
2003/0029431 A1 * 2/2003 Hepworth ..... B28D 1/225 125/13.03
2014/0238376 A1 * 8/2014 Courtemanche ..... B28D 1/225 125/23.01

FOREIGN PATENT DOCUMENTS

| | | |
|---|---|---|
| EP | 0 656 249 | 6/1995 |
| ES | 2 040 021 | 10/1993 |
| ES | 2 098 352 | 5/1997 |
| ES | 2 151 915 | 1/2001 |
| FR | 2 756 208 | 5/1998 |

OTHER PUBLICATIONS

International Search Report issued Mar. 9, 2015 in PCT/ES2015/070040.

* cited by examiner

*Primary Examiner* — Robert Rose
(74) *Attorney, Agent, or Firm* — Wenderoth, Lind & Ponack, L.L.P.

(57) ABSTRACT

The object of the invention is a modular machine for cutting ceramic pieces, comprising two towers (7), a central profile (5) and two lateral profiles (4) fastened to the two towers (7), at least two rigidity providing elements (14) between each lateral profile (4) and the central profile (5), two guides (9) fastened to the towers (7) and a number of guide reinforcements (28) around the guides (9), providing the guide (9) and a tool-bearing assembly (3) with precision, at least two floating platforms (6) supported on the rigidity providing elements (14) which constitute a support for the ceramic piece, a tool-bearing assembly (3) that may be displaced along the guides (9), such that the lateral profiles (4), the central profile (5), the guides (9) and the guide reinforcements (28) are fastened to the towers (7) in a dismountable fashion.

16 Claims, 11 Drawing Sheets

MODULAR MACHINE FOR CUTTING CERAMIC PIECES

OBJECT OF THE INVENTION

The present invention relates to a modular machine for cutting ceramic pieces, with a configuration of its components that reduces the weight thereof as well as improves the manoeuvrability and increases the robustness in comparison to ceramic cutters already known about in the state of the art.

TECHNICAL PROBLEM TO BE SOLVED AND BACKGROUND OF THE INVENTION

Ceramic cutters are currently formed by a base, a number of turrets supported on said base and a number of guides that run from turret to turret, a tool-bearing assembly comprising a number of runners sliding along these guides, said runners mainly being formed by self-lubricating bushings, nylons and bearings, etc.

The machine guides may have different configurations, including, inter alia, rounded tubes, solid round forms, forms with a rectangular cross-section or solid tyres, etc.

When large ceramic pieces are to be cut, ceramic cutters larger than usual are employed, which are nevertheless similar in design. In other words, they are also formed by a base, a number of turrets supported on said base and a number of guides that run from turret to turret, a tool-bearing assembly comprising a number of runners sliding along these guides.

The increased size of the machine for cutting large ceramic pieces consequently results in heavier materials, which are more robust, being used, thus meaning they resist the forces to which they are submitted upon said large ceramic pieces being cut.

Both the increased size and category of the materials used to manufacture machines for cutting large pieces considerably increases the weight and size of these ceramic cutters, thus making it rather difficult to transport the same from one place to another.

Likewise, special cutters for large sized pieces are problematic in terms of how easy they are to manoeuvre and how robust they are, these problems particularly being generated as a result of the extended length of the guides.

Machines for cutting large pieces manufactured with materials capable of resisting the forces generated upon cutting large pieces are very heavy, which makes it difficult to transport them from one place to another.

DESCRIPTION OF THE INVENTION

The invention described herein discloses a modular machine for cutting ceramic pieces, comprising two towers, a central profile and two lateral profiles, at least two rigidity providing elements between each lateral profile and the central profile, two guides fixed to the towers, a number of guide reinforcements located around the two guides, at least two floating platforms supported on the rigidity providing elements and a tool-bearing assembly that may be displaced along the guides.

In the modular machine for cutting ceramic pieces object of the invention, a lateral profile is located at each side of the central profile, the two floating platforms make up a support for the ceramic piece and the guide reinforcements reinforce the guides, providing rigidity and support to said guides, these guides being located in a higher position relative to the central profile and lateral profiles.

In the modular machine for cutting ceramic pieces object of the invention, the two lateral profiles, the central profile, the guides and the guide reinforcements are fastened to the towers in such a way that they may be disassembled, thus meaning the machine is modular, therefore distinguishing it from machines known about in the state of the art, the machine as such acquiring different dimensions by means of a change in the lateral profiles, the central profile and the guides.

The lateral profiles of the modular machine for cutting ceramic pieces object of the invention comprise a cross-section comprising a number of furrows, the central profile also comprising a cross-section comprising a number of furrows, such that the rigidity providing elements are joined to the profiles by means of screws, introduced into said furrows.

Each tower of the modular machine for cutting ceramic pieces object of the invention comprises a mortised piece, a number of projections where the guide reinforcements are connected and a number of through holes, where the lateral profiles, the central profile and the guides are fastened to said tower by means of screws introduced into said through holes of the mortised piece.

The cross-section of the central profile of the modular machine for cutting ceramic pieces object of the invention comprises a longitudinal groove, which admits a wear plate.

The modular machine for cutting ceramic pieces object of the invention comprises at least two support extension elements, which in turn comprise a plate joined to the lateral profile by means of an angular piece, the angular piece comprising a screw at one side, which fastens it to the furrow of the lateral profile and a plate connection at the other side.

The extension element plate is connected to the angular piece at two points, firstly being connected by means of a rotational connection to a fixed point of the angular piece and secondly also being connected to a circular perforation by means of a connection piece, the plate thus rotating around the rotational connection and the rotation of the plate being limited by the course followed by the connection piece along the length of the circular perforation.

The connection piece that joins the plate to the circular perforation in the angular piece is a shock-absorber, comprising a screw and a nut, with an elastic element located between the head of the screw and the nut.

The floating platforms of the modular machine for cutting ceramic pieces object of the invention are supported on each rigidity providing element by means of at least one support, each support comprising a central body and a surrounding elastic element, such that the support of the floating platforms on the rigidity providing elements is an elastic joint.

The tool-bearing assembly of the modular machine for cutting ceramic pieces object of the invention comprises two runners which are displaced along the two guides, each runner for the displacement thereof being supported on two bushings, such that the bushings comprise a projection, which is inserted into a groove made in the runner, thus preventing the bushings from moving as the runner is displaced.

The guide reinforcement of the modular machine for cutting ceramic pieces object of the invention comprises a cross-section comprising a tab, said tab of the guide reinforcement being introduced into a slot in each runner, helping to guide the runner along the guide.

The tool-bearing assembly of the modular machine for cutting ceramic pieces object of the invention also comprises a number of hold-down plates located such that they come into contact with the ceramic piece and, a number of protection elements, placed such that they cover the hold-down plates so as to protect the ceramic piece.

The wear plate of the machine object of the invention comprises a solid metal piece with a rectangular profile.

In a cutting operation carried out in the modular machine object of the invention, the ceramic piece is located on the wear plate and pressure is exerted thereon by the hold-down plates until said ceramic piece is cut.

DESCRIPTION OF THE DRAWINGS

In order to complete the present description, with the aim of facilitating a better understanding of the invention characteristics, the present descriptive specification is accompanied by a set of drawings, which form an integral part thereof and provide a non-limiting illustration of the following.

Figure 1:
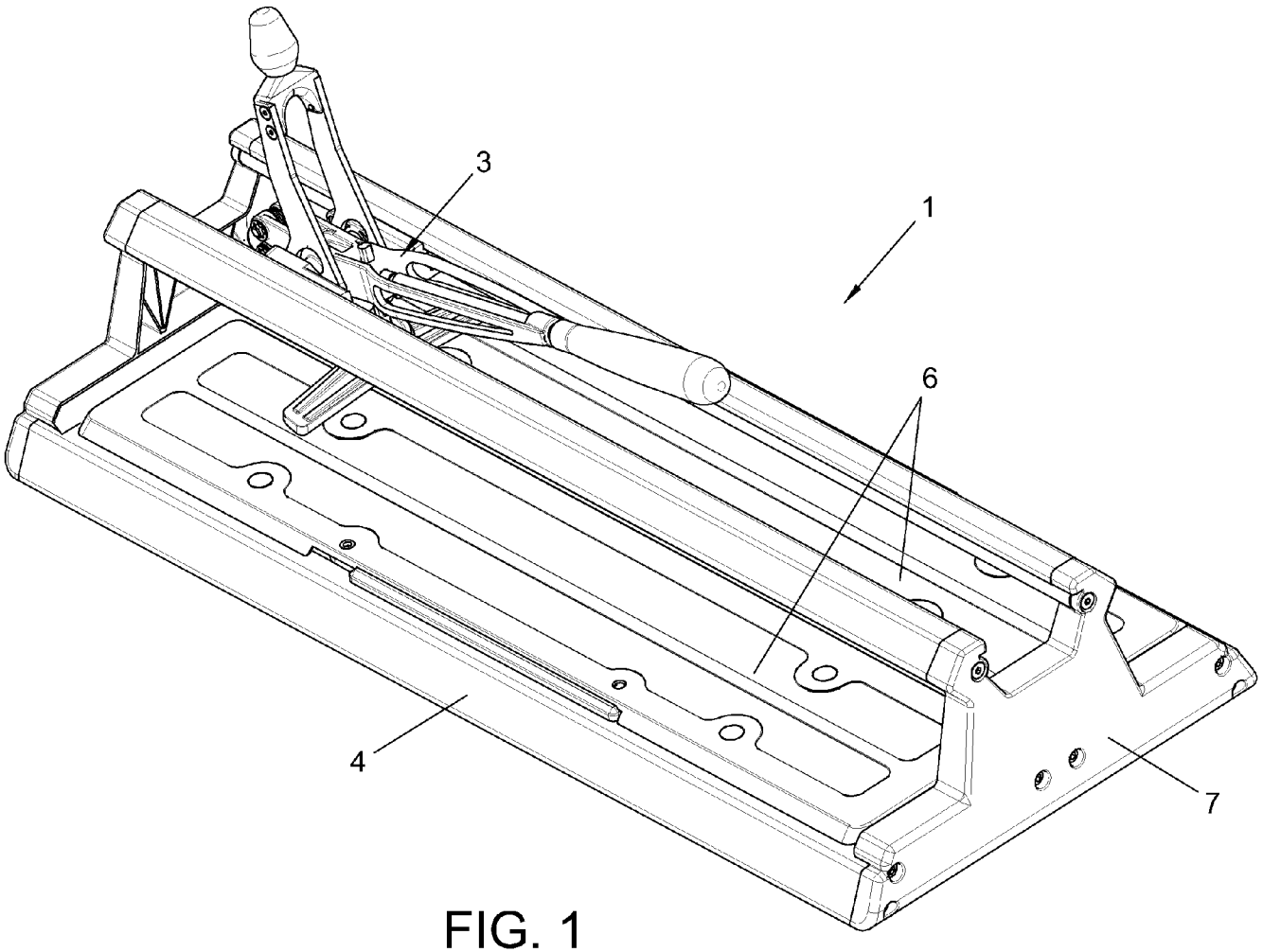
FIG. 1 is a perspective view of one embodiment of the machine object of the invention.
Figure 2:
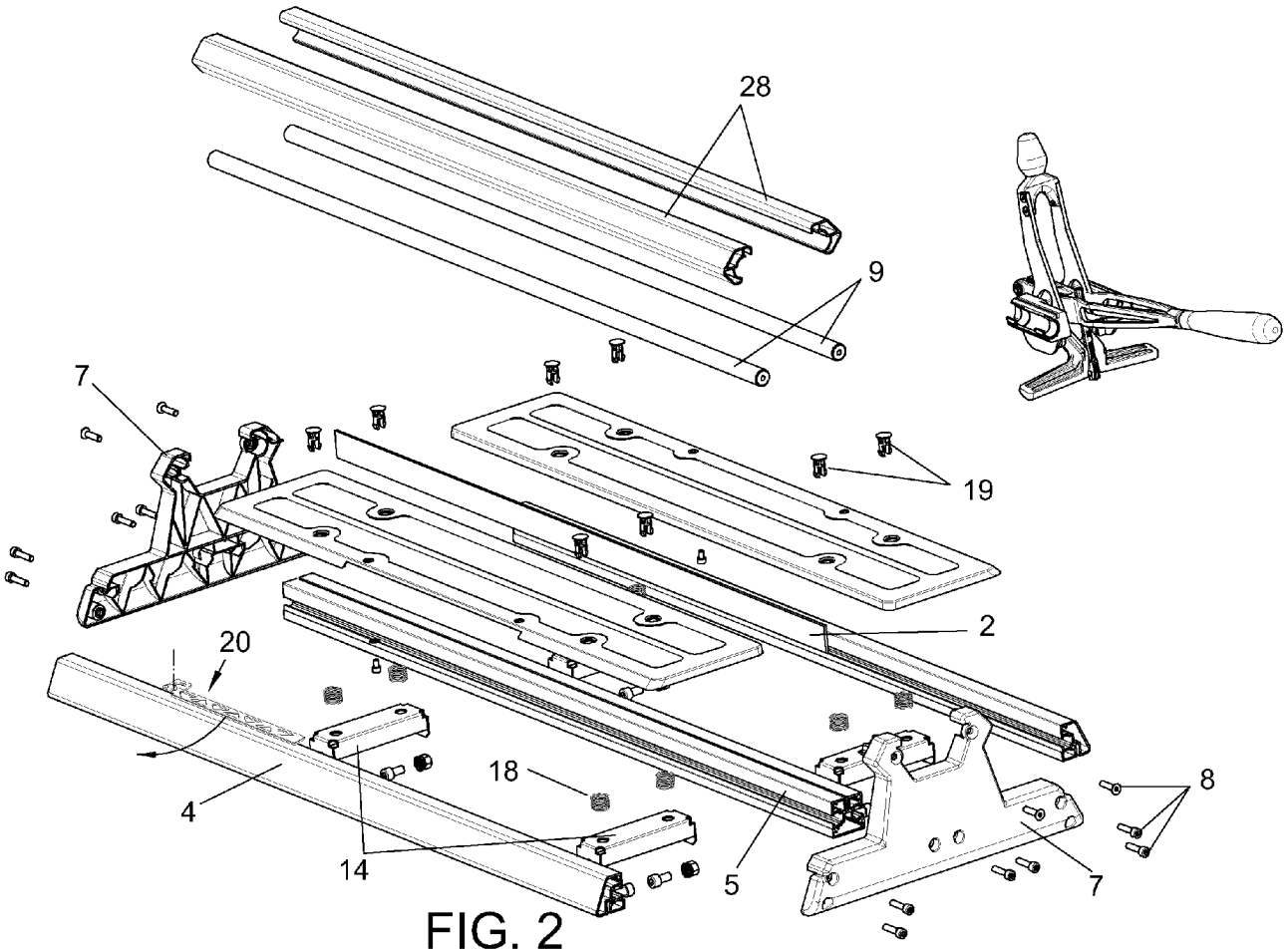
FIG. 2 is an exploded view of one embodiment of the machine object of the invention, as shown in FIG. 1.

The various numerical references employed in the figures correspond to the following elements:

1.—machine,
2.—wear plate,
3.—tool-bearing assembly,
4.—lateral profiles,
5.—central profile,
6.—floating platforms,
7.—towers,
8.—screws
9.—guides,
10.—mortised piece,
11.—internal ribs,
12.—through holes,
13*a*; 13*b*.—furrows,
14.—rigidity providing element
15.—longitudinal groove,
16.—hold-down plate,
17.—support,
18.—surrounding elastic element,
19.—fixed central area,
20.—support extension element,
21.—plate,
22.—angular piece,
23.—circular perforation,
24.—connection piece,
25.—rotational connection,
26.—nuts,
27.—elastic element,
28.—guide reinforcement,
29.—runner,
30.—bushings,
31.—projection,
32.—groove,
33.—protection element,
34.—first lever,
35.—second lever,
36.—lid,
37.—projection,
38.—tab,
39.—furrow.

PREFERRED EMBODIMENT OF THE INVENTION

The machine (1) object of the invention is a ceramic cutting machine (1) designed to cut large ceramic pieces, whilst being robust and easy to manoeuvre—something which no machine existing up to date has been able to provide. The machine (1) object of the invention is also lighter than other machines for cutting large ceramic pieces available on the market.

Ceramic pieces are cut in two successive operative stages. In a first operation, the ceramic piece is marked with a line showing where the same is to be subsequently cut, whilst in the second operation, the ceramic piece is submitted to pressure, such that it breaks along the cut line previously marked during the marking stage.

The machine (1) for cutting large ceramic pieces object of the invention is modular, may be disassembled, and comprises:

- a central profile (5) and two lateral profiles (4) located one at each side of the central profile (5);
- two towers (7), to which the lateral profiles (4) and the central profile (5) are fastened by means of screws (8);
- two guides (9), which run from one tower (7) to the other (7), being fastened to the towers (7) by means of screws (8), said guides (9) being located in a higher position relative to the base;
- two guide reinforcements (28), such that a guide reinforcement (28) is located on each guide (9);
- a tool-bearing assembly (3), which slides along the guides (9) with the help of the guide reinforcement (28).

Figure 8:
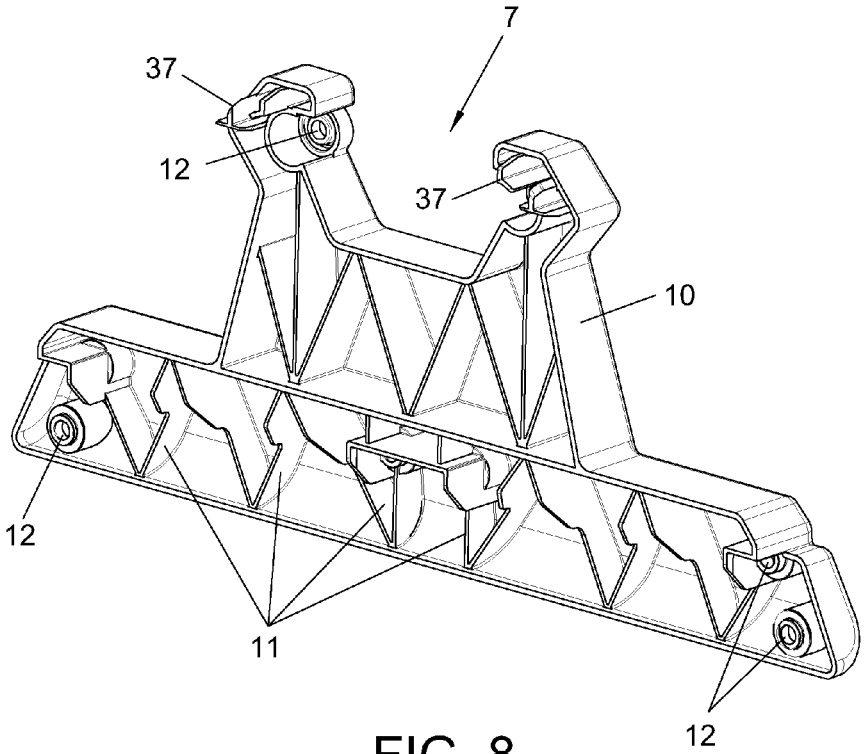
FIG. 8 is a perspective view of a tower of the machine object of the invention.

In the machine (1) object of the invention, the lateral profiles (4), the central profile (5) and the guides (9) are fixed to the towers (7) by means of screws (8), whilst the guide reinforcements (28) are fixed to the towers (7) via a number of projections (37) built into said towers. The abovementioned towers (7) (a tower may be observed in FIG. 8) are configured as a mortised piece (10), the mortised piece (10) being made rigid by means of a number of internal ribs (11), also comprising a number of through holes (12) into which the screws (8) that fasten the lateral profiles (4) the central profile (5) and the guides (9) to the tower (7) are introduced.

Figure 5:
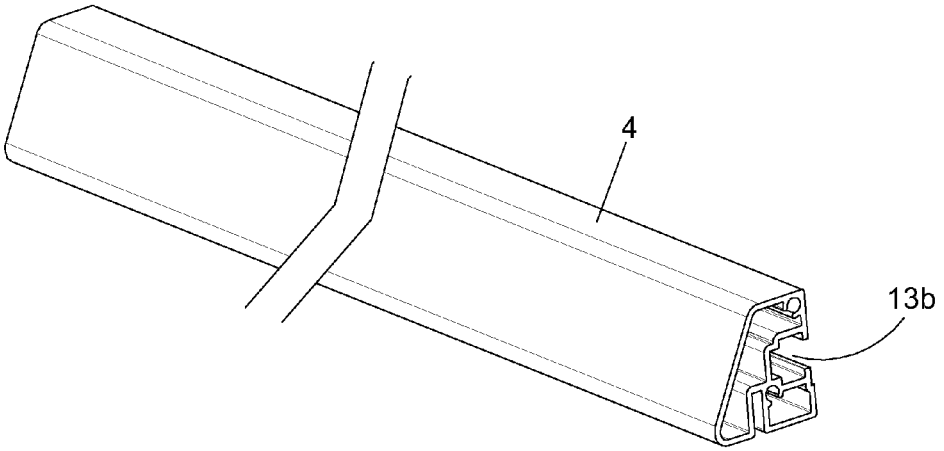
FIG. 5 is a perspective view of a lateral profile of the machine object of the invention.
Figure 6:
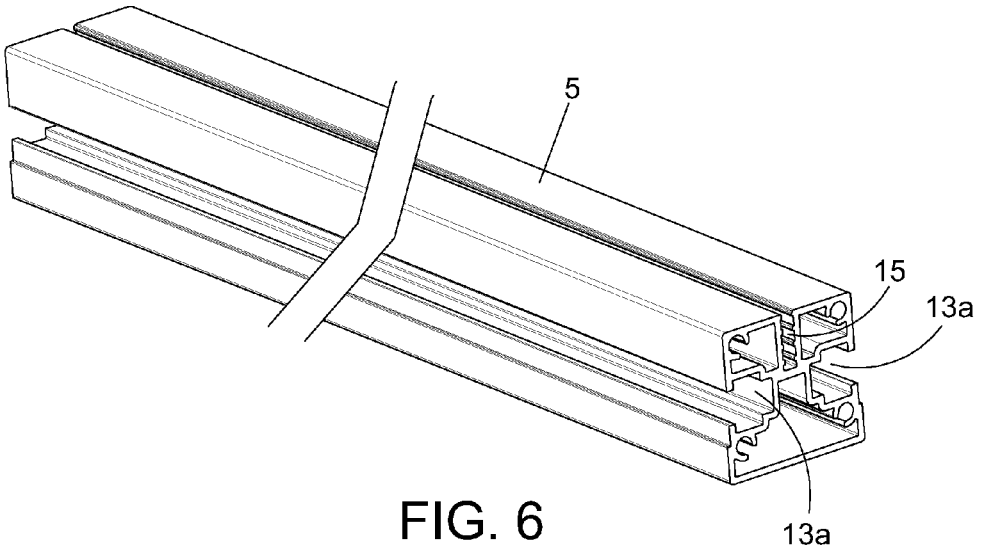
FIG. 6 is a perspective view of a central profile of the machine object of the invention.
Figure 7:
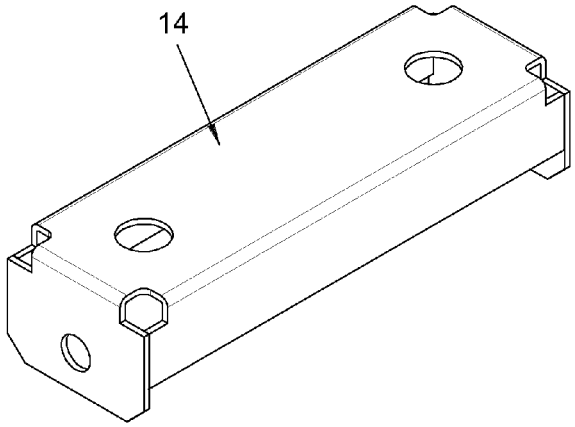
FIG. 7 is a perspective view of a rigidity providing element of the machine object of the invention.

Both the lateral profiles (4) and the central profile (5) are made up by a number of extrusion profiles. The central profile (5) has a cross-section (as shown in FIG. 6), comprising a number of furrows (13*a*) located on the sides of said central profile (5) and, a longitudinal groove (15) located in the upper portion of the central profile (5). The lateral profiles (4) (it being possible to observe one lateral profile in FIG. 5) have a cross-section comprising a number of furrows (13*b*), which are opposite to the furrows (13*a*) in the central profile (5) alongside all of the profiles (4, 5) of the machine (1) connected to the towers (7). In the machine (1) object of the invention, at least two rigidity providing elements (14) are located between each cross-section profile (4) and the central profile (5) (it being possible to observe a rigidity providing element in FIG. 7), which are connected to the furrows (13*a*, 13*b*) of the profiles (4, 5) by means of screws (8) and nuts (26), such that either the head of the screw (8) or the nut (26) is introduced into the furrows (13*a*, 13*b*) of the profiles (4, 5) such that the rigidity providing elements (14) may be displaced such that they are supported in the furrows (13*a*, 13*b*) along the length of said profiles (4, 5).

Figure 3:
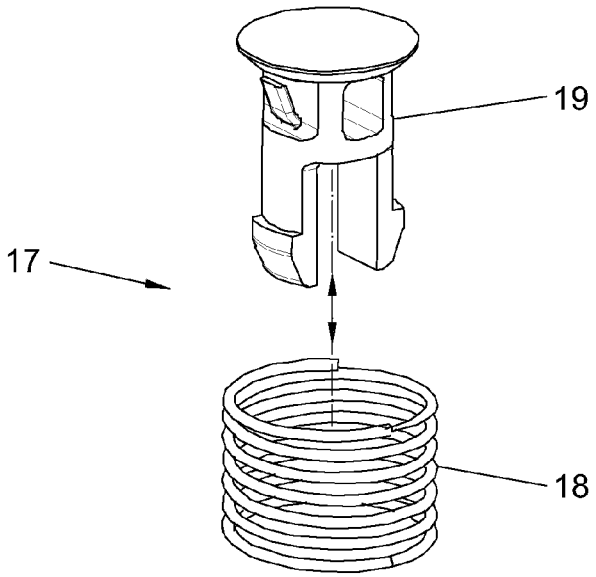
FIG. 3 is an exploded view of the floating table being supported on the rigidity providing element.
Figure 9:
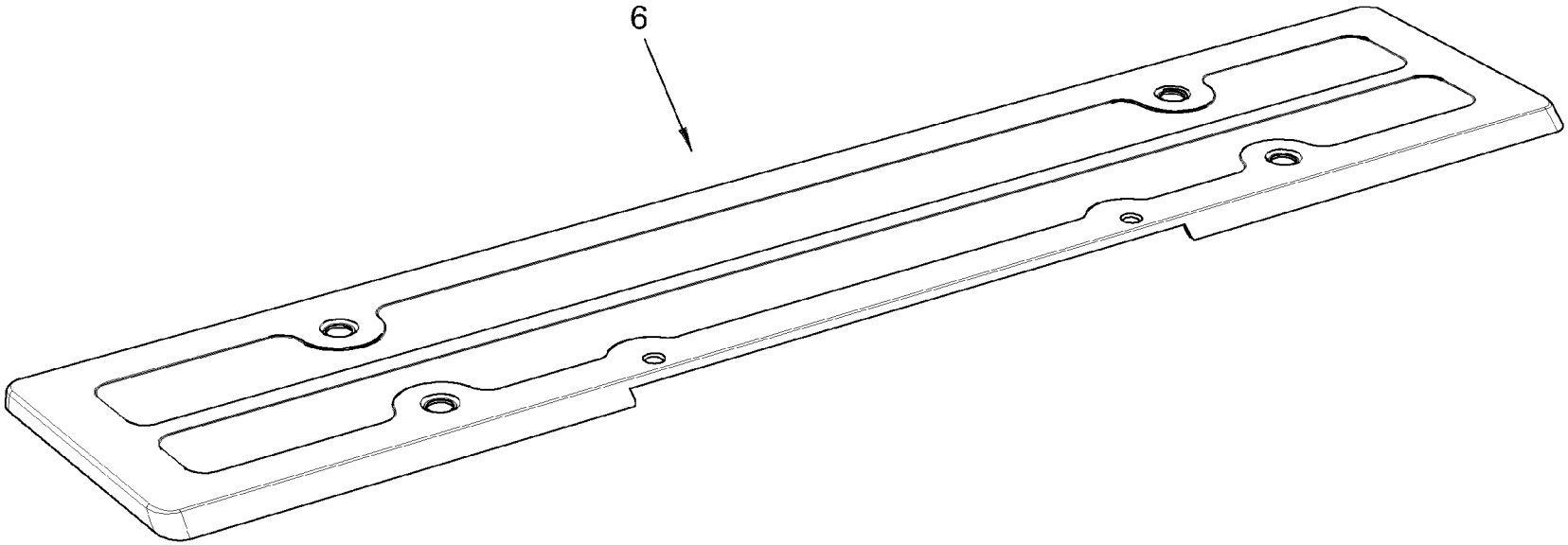
FIG. 9 is a perspective view of a floating table of the machine object of the invention.

A number of floating platforms (6) are located on the rigidity providing elements (14) (it being possible to observe a floating table in FIG. 9), which are fastened to said rigidity providing elements (14) by means of supports (17) (shown in FIG. 3), which comprise a fixed central area (19) and a surrounding elastic element (18) located around the fixed central area (19), the surrounding elastic element (18) being a spring in the preferred embodiment of the invention, such that the floating platforms (6) facilitate the elastic support of the ceramic piece on the machine (1).

The longitudinal groove (15) of the cross-section of the central profile (5) is designed to admit a wear plate (2) said wear plate (2) being a solid metal profile with a rectangular section.

The ceramic piece is located on the machine, supported on the floating platforms (6) and on the wear plate (2), such that the modular machine (1) for cutting ceramic pieces object of the invention exerts pressure on the wear plate (2) in order to cut the ceramic piece.

Figure 4:
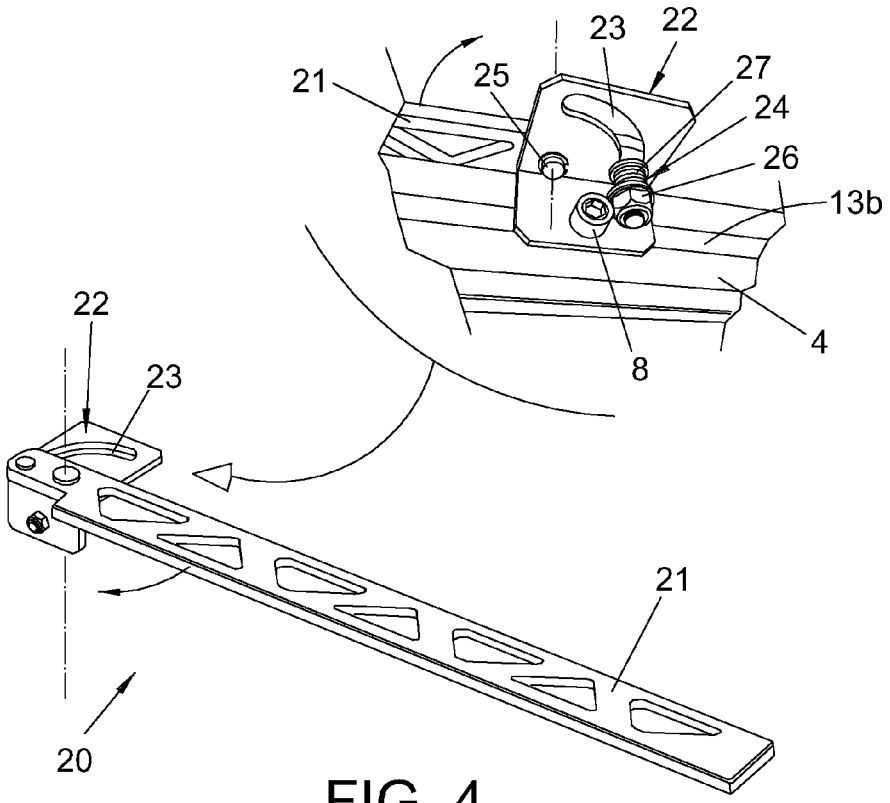
FIG. 4 is a perspective view of the support extension element, the join between said support and the lateral profile being shown in detail.

In the event of part of the ceramic piece to be cut falling outside said floating platforms (6) as a result of being too large or given the type of cut to be made when positioned on the same (6), the machine (1) object of the invention comprises a number of support extension elements (20). The support extension elements (20) (which may be observed in FIG. 4) comprise a number of plates (21) fixed to the furrows (13*b*) in the lateral profiles (5) by means of a number of angular pieces (22), each angular piece (22) being fastened at one side by means of a screw (8) to the furrow (13*b*), a connection for the plates (21) being incorporated into the other side of the angular piece (22). The side of the angular piece (22) to which the plate (21) is joined comprises a circular perforation (23).

The connection between the plates (21) and the angular piece (22) makes it possible for the plate (21) to rotate and be displaced from a portion parallel to the lateral profile (4) (in this position, the support extension (20) being hidden under the floating table (6)) to another position perpendicular to said lateral profile (4). The plate (4) is connected to the angular piece (22) at two points, firstly being connected to a fixed point of the angular piece (22) by means of a rotational connection (25) and secondly also being connected to the circular perforation (23) by means of a connection piece (24), the plate (21) as such rotating around the rotational connection (25), the movement thereof being limited by the course followed by the connection piece (24) along the length of the circular perforation (23).

The connection piece (24) is a shock-absorber, comprising a screw (8) and a nut (26) with an elastic element (27) located between the head of the screw (8) and the nut (26), the plate (21) therefore possessing a certain degree of flexibility, which facilitates the placing and breaking of large ceramic pieces.

The guides (9) are made from a steel profile with a circular section, which facilitates the guiding of the runners (29), said steel profile being capable of supporting the forces to which the guide (9) is subjected, during the operation in which the ceramic piece is marked and the operation in which said ceramic piece is cut.

The guide reinforcements (28) are located around the guides (9), said guide reinforcements (28) preventing the guides (9) from warping when carrying out the marking or cutting operation on the ceramic piece, i.e. when a force is submitted to the guides (9).

Figure 10:
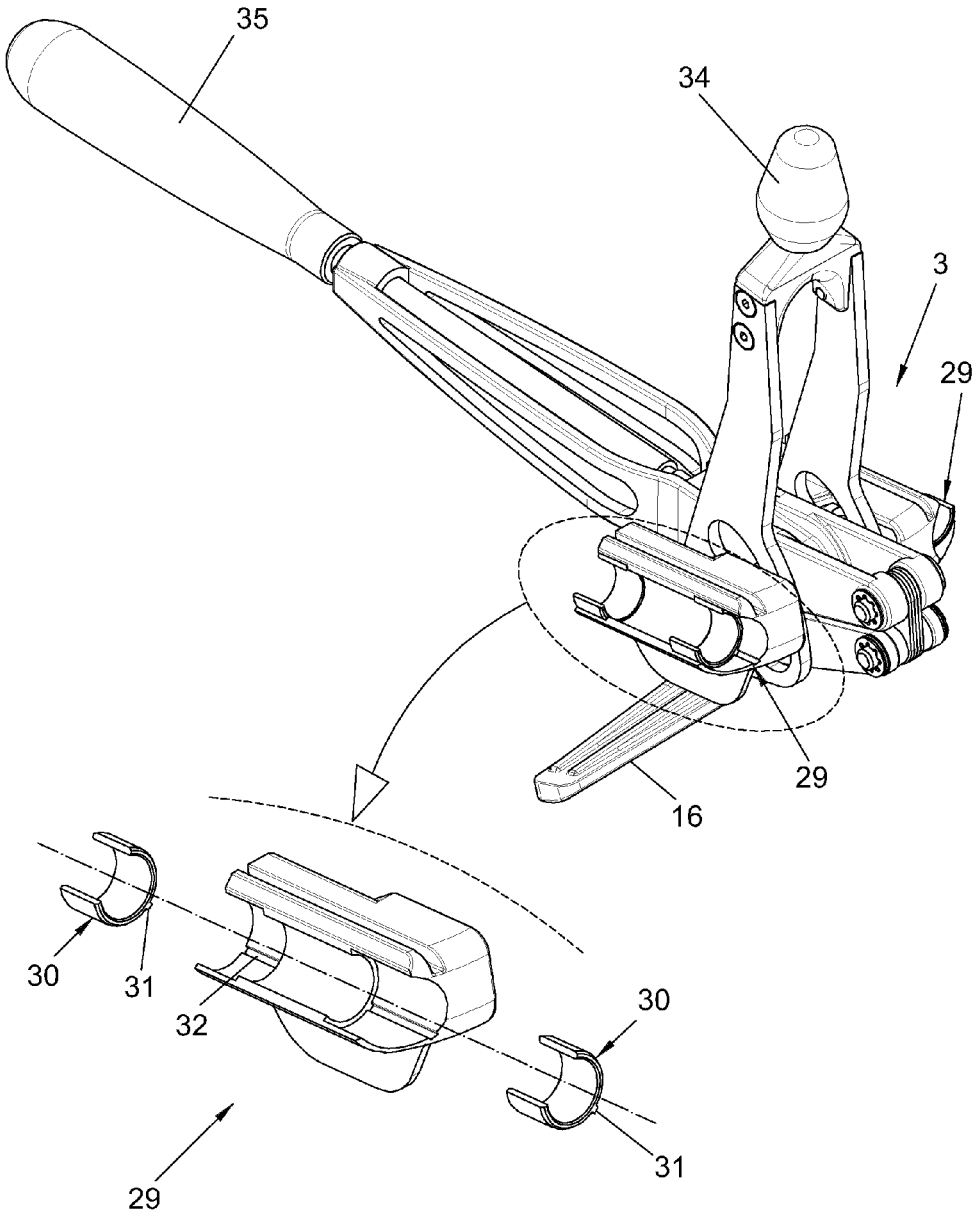
FIG. 10 is a perspective view of the tool-bearing assembly of the machine object of the invention, wherein the runner of said tool-bearing assembly is shown in detail.

Moreover, the tool-bearing assembly (3) (seen in FIG. 10) comprises two runners (29) (shown in detail in FIG. 10), in order to facilitate the displacement thereof on the guides (9), these being located such that they correspond to the guides (9). Each runner (29) is displaced on the guide (9) supported on two bushings (30), the bushings (30) comprising a projection (31) which is inserted into a groove (32) made in the runner (29), so as to prevent the bushings (30) from being displaced from their operative position. Likewise, the guide reinforcement (28) comprises a cross-section with a built-in tab (38), which is introduced into a slot (39) made lengthways in the groove (29) by the upper portion of said runner (29), such that the runner (29) is displaced along the length of the guide (9) supported on the bushings (30) and on the tab (38) of the guide reinforcement (28) introduced into the slot (39) of said runner (29).

Figure 11:
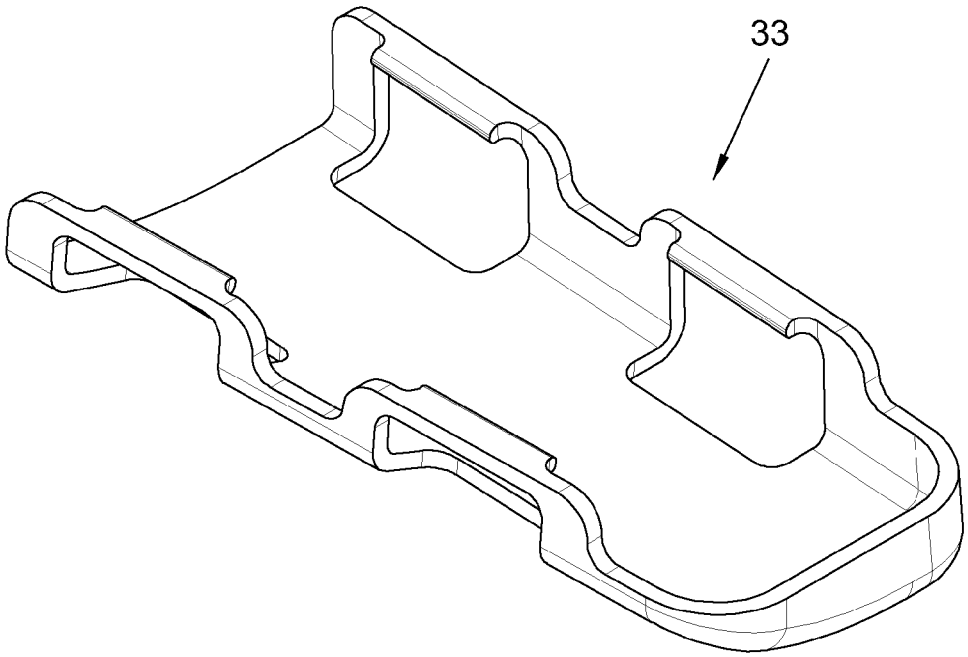
FIG. 11 is a perspective view of a protection element for protecting the hold-down plate of the tool-bearing assembly of the machine object of the invention.

The tool-bearing assembly (3) is an element known about in the state of the art, said tool-bearing assembly (3) comprising a number of hold-down plates (16), which exert the pressure needed onto said ceramic piece until it breaks. The hold-down plates (16) have protection elements (33) (which can be seen in FIG. 11), which are placed such that they cover the hold-down plates (16) in the event of the ceramic piece having a delicate surface upon which the hold-down plates are supported.

The tool-bearing assembly (3) comprises two levers; a first lever (34), which displaces the tool-bearing assembly (3) vertically such that the hold-down plates (16) exert pressure on the ceramic piece until it breaks and, a second lever (35) used as a handle to displace the tool-bearing assembly (3) along the length of the guides (4) and to mark the ceramic piece.

Figure 12:
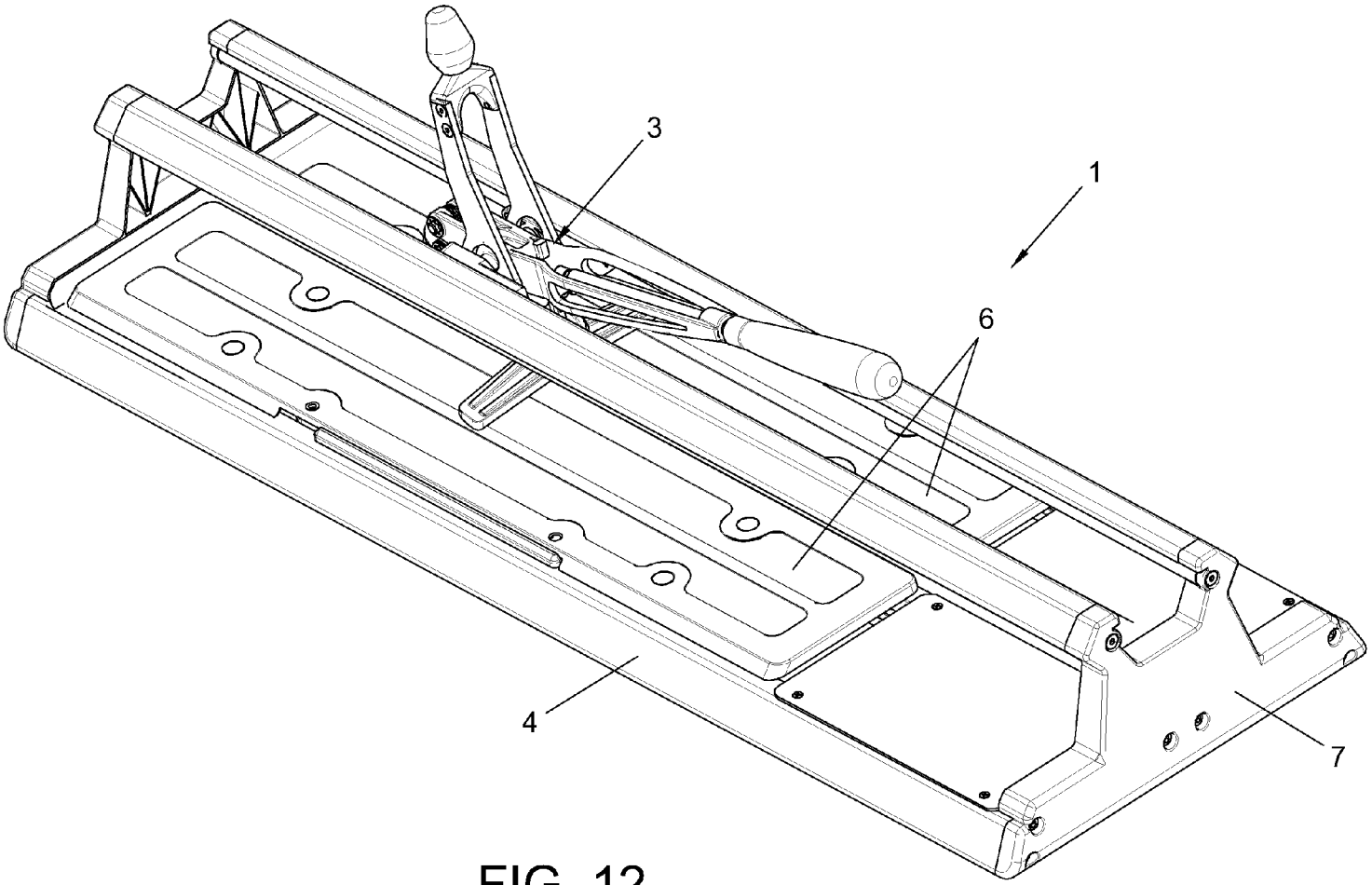
FIG. 12 is a perspective view of a second embodiment of the machine object of the invention.
Figure 13:
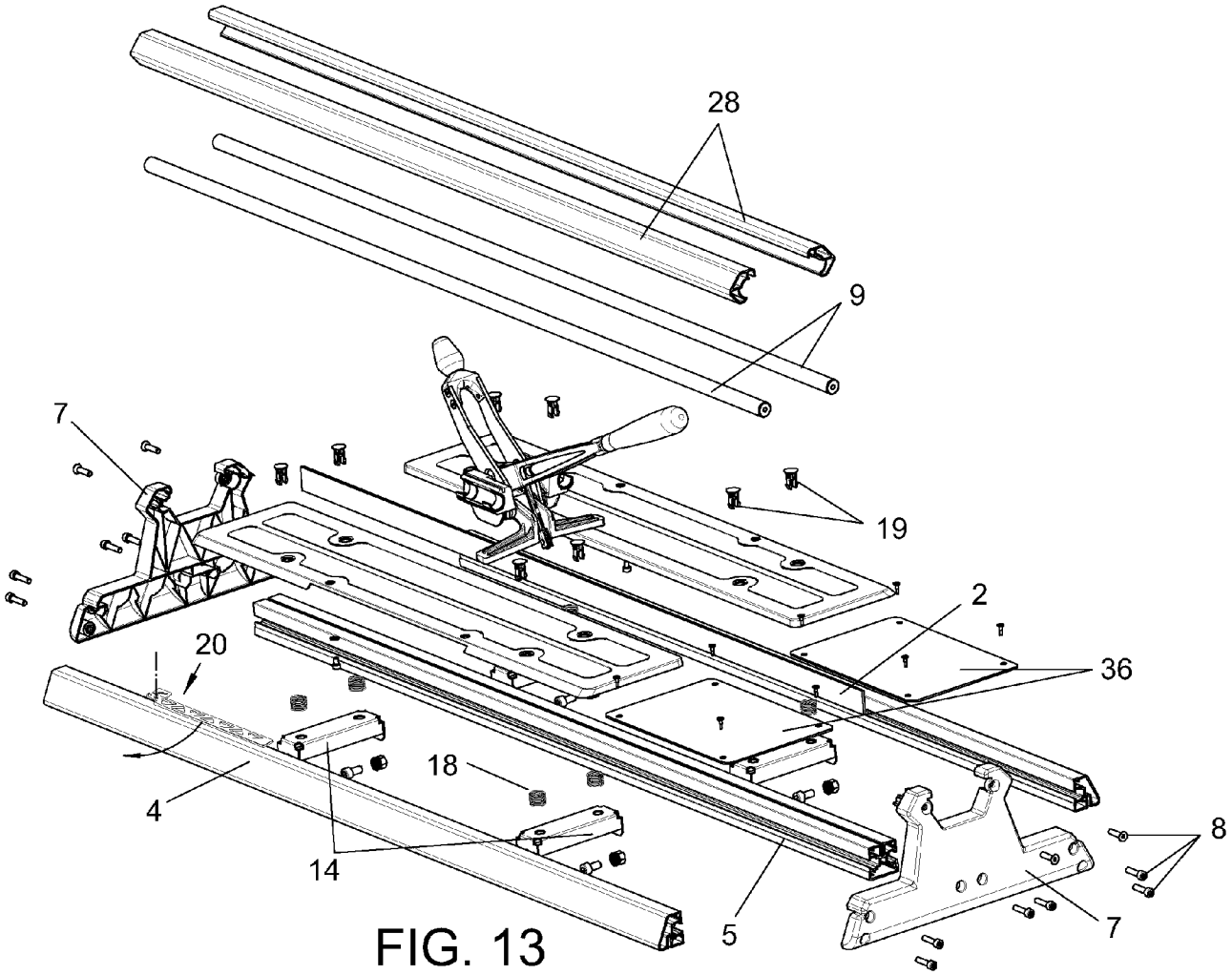
FIG. 13 is an exploded view of the embodiment of the machine object of the invention, as shown in FIG. 12.
Figure 14:
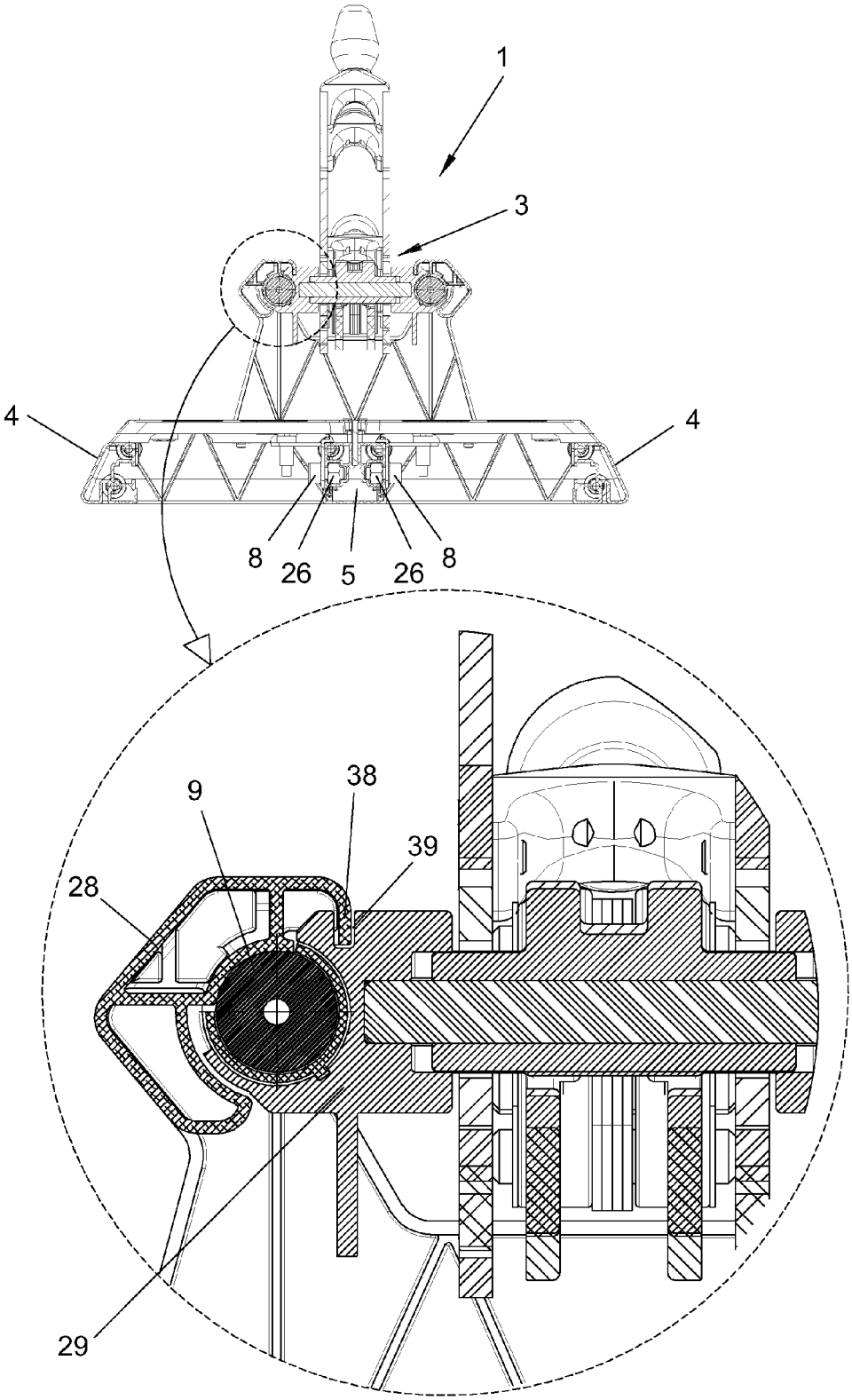
FIG. 14 is a cross-section of the machine object of the invention, showing the guide with the guide reinforcement in detail.

Since the machine (1) is modular, should a greater support surface be required for the ceramic piece, the lateral profiles (4), the central profile (5), the guides (9) and the guide reinforcements (28) are replaced by longer alternatives and a number of lids (36) are subsequently fitted to the floating platforms (6) (a machine into which a number of lids have been incorporated may be seen in FIGS. 12 and 13).

Experts ordinarily skilled in the art will understand that other embodiments may be considered on the basis of the detailed description, although the fundamental characteristics of the invention are set forth in the claims below.

The invention claimed is:

1. A modular machine (1) for cutting ceramic pieces, wherein it comprises:

two towers (7);

a central profile (5) and two lateral profiles (4), with a lateral profile (4) at each side of the central profile (5), the central profile (5) and the two lateral profiles (4) being fastened to the two towers (7);

at least two rigidity providing elements (14) between each lateral profile (4) and the central profile (5);

two guides (9) fastened to the towers (7), the guides (9) being positioned higher up than the central profile (5) and the lateral profile (4);

a number of guide reinforcements (28) located on the two guides (9), which reinforce the guides (9), providing said guides (9) with rigidity and support;

at least two floating platforms (6) supported on the rigidity providing elements (14) which constitute a support for the ceramic piece;

a tool-bearing assembly (3), which may be displaced along the guides (9);

such that the lateral profiles (4), the central profile (5), the guides (9) and the guide reinforcements (28) are fastened to the towers (7) in a dismountable fashion and the machine (1) acquires different dimensions by means of changing the lateral profiles (4), the central profile (5) and the guides (9).

2. The modular machine (1) for cutting ceramic pieces according to claim 1, wherein:

the lateral profiles (4) comprise a cross-section comprising a number of furrows (13*b*) and;

the central profile (5) comprises a cross-section comprising a number of furrows (13*a*);

such that the rigidity providing elements (14) are joined to the profiles (4, 5) by means of screws (8) introduced into said furrows (13*a*, 13*b*).

3. The modular machine (1) for cutting ceramic pieces according to claim 1, wherein each tower (7) comprises a mortised piece (10) comprising:

a number of internal ribs (11) which make the mortised piece (10) rigid;

a number of projections (37), where the guide reinforcements (28) are connected and;

a number of through-holes (12), where the lateral profiles (4), the central profile (5) and the guides (9) are fastened to said tower (7).

4. The modular machine (1) for cutting ceramic pieces according to claim 3, wherein the lateral profiles (4), the central profile (5) and the guides (9) are fastened to the towers (7) by means of screws (8) introduced into the through-holes of the mortised piece (10).

5. The modular machine (1) for cutting ceramic pieces according to claim 2, wherein the cross-section of the central profile (5) comprises a longitudinal groove (15) that admits a wear plate (2).

6. The modular machine (1) for cutting ceramic pieces according claim 2, wherein in that it comprises at least two support extensions (20), which in turn comprise a plate (21) joined to the lateral profile (4) by means of an angular piece (22), the angular piece (22) comprising a screw (8) on one side, which fastens it to the furrow (13*b*) of the lateral profile (4) and comprising a connection for the plate (21) at the other side.

7. The modular machine (1) for cutting ceramic pieces according to claim 6, wherein the plate (21) is connected to the angular piece (22) at two points, firstly being connected to a fixed point of the angular piece (22) by means of a rotational connection (25) and secondly being connected to a circular perforation (23) by means of a connection piece (24), the plate (21) thus rotating around the rotational connection (25), the rotation of the plate (21) being limited by the course followed by the connection piece (24) along the length of the circular perforation (23).

8. The modular machine (1) for cutting ceramic pieces according to claim 7, wherein the connection piece (24) is a shock-absorber comprising a screw (8) and a nut (26), with an elastic element (27) located between the head of the screw (8) and the nut (26).

9. The modular machine (1) for cutting ceramic pieces according to claim 1, wherein the floating platforms (6) are supported on each of the rigidity providing elements (14) by means of at least one support (17), where each support (17) comprises a central body (19) and a surrounding elastic element (18), such that the floating table (6) support on the rigidity providing elements (14) constitutes an elastic join.

10. The modular machine (1) for cutting ceramic pieces according to claim 1, wherein the tool-bearing assembly (3) comprises two runners (29), which are displaced along the two guides (9), each runner being supported on two bushings (30) in order to be displaced, such that the bushings (30) comprise a projection (31), which is inserted into a groove (32) made in the runner (29), thus preventing the bushings (30) from moving as the runner (29) is displaced.

11. The modular machine (1) for cutting ceramic pieces according to claim 10, wherein the guide reinforcement (28) comprises a cross-section comprising a tab (38), said tab (38) of the guide reinforcement (28) being introduced into a slot (39) in each runner (29), helping to guide the runner (29) on the guide (9).

12. The modular machine (1) for cutting ceramic pieces according to claim 10, wherein the tool-bearing assembly (3) comprises a number of hold-down plates (16), located such that they come into contact with the ceramic piece and, a number of protection elements (33), which are placed such that they cover the hold-down plates (16) so as to protect the ceramic piece.

13. The modular machine (1) for cutting ceramic pieces according claim 5 wherein the wear plate (2) comprises a solid metal piece, comprising a rectangular profile.

14. The modular machine (1) for cutting ceramic pieces according to claim 12, wherein in a cutting operation, the ceramic piece is located on the wear plate (2) and receives pressure from the hold-down plates (16), until said ceramic piece is cut.

15. The modular machine (1) for cutting ceramic pieces according to claim 13, wherein in a cutting operation, the ceramic piece is located on the wear plate (2) and receives pressure from the hold-down plates (16), until said ceramic piece is cut.

16. The modular machine (1) for cutting ceramic pieces according to claim 1, wherein the lateral profiles (4) comprise a cross-section comprising a number of furrows (13*b*) and;

the central profile (5) comprises a cross-section comprising a number of furrows (13*a*);

such that the rigidity providing elements (14) are joined to the profiles (4, 5) by means of screws (8) introduced into said furrows (13*a*, 13*b*);

wherein the cross-section of the central profile (5) comprises a longitudinal groove (15) that admits a wear plate (2);

wherein the wear plate (2) comprises a solid metal piece, comprising a rectangular profile;

wherein the tool-bearing assembly (3) comprises two runners (29), which are displaced along the two guides (9), each runner being supported on two bushings (30) in order to be displaced, such that the bushings (30) comprise a projection (31), which is inserted into a groove (32) made in the runner (29), thus preventing the bushings (30) from moving as the runner (29) is displaced;

wherein the tool-bearing assembly (3) comprises a number of hold-down plates (16), located such that they come into contact with the ceramic piece and, a number of protection elements (33), which are placed such that they cover the hold-down plates (16) so as to protect the ceramic piece; and wherein in a cutting operation, the ceramic piece is located on the wear plate (2) and receives pressure from the hold-down plates (16), until said ceramic piece is cut.

* * * * *